United States Patent [19]

Laufenburg

[11] 4,002,361

[45] Jan. 11, 1977

[54] WINDOW FASTENER

[76] Inventor: Willy Laufenburg, BRD, Torwiesenweg 20, Wilnsdorf-Niederielfen, Germany

[22] Filed: May 9, 1975

[21] Appl. No.: 575,950

Related U.S. Application Data

[63] Continuation of Ser. No. 433,101, Jan. 14, 1974.

[30] Foreign Application Priority Data

Jan. 23, 1973 Germany ..... 2303114

[52] U.S. Cl. ..... 292/336.3; 70/451; 292/337; 292/DIG. 53

[51] Int. Cl.[2] ..... E05B 3/00; E05B 9/00; E05B 9/08

[58] Field of Search ..... 70/1, 89, 100, 431, 70/448–449, 451, 466; 292/1, 39, 142, 172, 336.3, 337, DIG. 53, DIG. 64

[56] References Cited

UNITED STATES PATENTS

| | | | |
|---|---|---|---|
| 3,479,074 | 11/1969 | Schlage | 70/451 X |

FOREIGN PATENTS OR APPLICATIONS

| | | | |
|---|---|---|---|
| 130,599 | 11/1932 | Austria | 292/142 |
| 34,410 | 6/1965 | Finland | 292/336.3 |
| 1,559,735 | 8/1969 | Germany | 292/142 |
| 865,113 | 1/1953 | Germany | 292/39 |
| B21,302 | 10/1955 | Germany | 292/114 |
| 200,921 | 1/1966 | Sweden | 292/265 |

*Primary Examiner*—Paul R. Gilliam
*Assistant Examiner*—Carl F. Pietruszka
*Attorney, Agent, or Firm*—Norman S. Blodgett; Gerry A. Blodgett

[57] ABSTRACT

Window fastener having a rotatable gear engaging an actuating member formed with a rack and a method of installing.

13 Claims, 6 Drawing Figures

WINDOW FASTENER

This is a continuation of application Ser. No. 433,101 filed Jan. 14, 1974.

BACKGROUND OF THE INVENTION

The invention is concerned with a window fastener drive with at least one rotatable member, such as a pinion supported within a housing and guided within the housing by an actuating member such as a gear rack engaging the pinion. The housing is received in a groove containing the actuating member. The actuating member is positioned so as to extend from the housing. An area limited by bow-shaped edges and areas contains the rotatable member. The housing is in addition received and supported in the groove by bow-shaped limited depressions. The groove as well as the depressions can be formed in a beam, especially within the frame of a window or door. The fastening of the drive within the groove and the depression involves the use of bolts extending parallel to the axis of the rotatable member into the housing. Small window fastener drives of this kind are used mainly in connection with connecting rod fixtures on windows, doors, and similar opening closures, as shown in German Pat. Nos. 1,202,174 and 1,235,769. German Pat. Nos. 1,849,948 and 1,988,521 also incorporate similar small drives in connection with connecting rod fixtures for windows and doors.

A characteristic feature of the above-named patents describing gear-rack drives consists in the fact that the drive housing is fastened to the back side of the plate which serves as the cover for a groove formed in the frame of the window. The gear rack lies within the groove and is designed as part of the actuating member guided within the drive housing and can be displaced a certain amount. In this case, the actuating member, along with the housing, is positioned naturally within the groove. The housing with the supported rotatable member is received in a depression which penetrates the base of the groove and is formed by a milling cutter in the frame of the window. The fastening of the drive and the drive housing within the groove and the attached depression is accomplished with bolts. These bolts are parallel to the supporting axis of the rotatable member and penetrate the holes or threaded sleeves of the drive housing and directly or indirectly find their counter-support within the frame.

An actuating handle for moving the rotatable member engages a lateral depression in the frame co-axial of the support axis of the rotatable member and also the depression starting at the groove base, which, together with the holes for the bolts, can be fabricated for example by use of a multiple-drill head.

It has proven to be a disadvantage that the depression within the groove for mounting the housing and the holes for the pin of the actuating handle, as well as the fastening bolts for the handle support rosette and the drive housing, be formed in separate working steps. This is because they extend at a right angle to each other and, in addition, they are positioned in different profile zones of the frame.

In recognition of these disadvantages, the drives of connecting rod window fixtures have already been designed in such a way that the housing area containing the rotatable member is received in a depression formed by a hole inside the window frame. This hole is arranged axially of the pin for moving the handles which actuate the rotatable member. For this purpose, the rotatable member of the drive-receiving area of the drive housing is tightly fitted to the circumference of the rotatable member and the hole penetrating the area of the connecting rod groove or of the notch in the frame has a diameter of a size that the drive housing can be received without any difficulty.

The bolts serving to fasten the drive housing and establishing the position of the drive are designed to be located laterally of area of the rotatable member-containing housing. They are anchored within the material of the frame and, therefore, engage it completely unsymmetrically and opposite to the acting plane of the drive members displaced to one side of the drive housing.

This situation can be especially of disadvantage when the drive members or the fixtures to be actuated by the connecting rod only are difficult to adjust. The reaction forces present on the drive housing act are entirely at one side of the fastening bolts and they can be slowly loosened.

In another known connecting rod drive the fastening of the drive housing by bolts which are arranged parallel to the axis of the rotatable member was completely omitted and in its place only the fastening bolts for the handle rosette was screwed in beside the drive housing in the material of the window frame.

The invention is also concerned with a procedure for mounting of gear locks for corner closures or similar connecting rod fixtures mounted in a groove-equipped frame of the window or doors, whereby the area of the gear housing with the pinion and the engagement for the fastening screws of the handle rosette are inserted into a cavity extending to the connecting rod groove.

In order to mount such gear apparatus in the frame of a window it has until now been done in such a way that, first, the depression was formed close to the groove of the gear rack groove with the help of a disc cutter or a chain cutter from the groove side and thereafter the holes were made by a special operation in the transverse direction, so that the handle pin can penetrate the pinion and the fastening bolts penetrate the holes of the gear lock. Such a procedure is time consuming and complicated and, therefore, is contrary to the efficient program for window and door fabrication that is appearing more and more.

It is, therefore, an outstanding object of the invention to provide a window fastener which eliminates completely the previously-described disadvantages for mounting and fastening.

Another object of this invention is the provision of a window-fastener drive design which permits a direct anchoring of its housing in the area of the plane of action of the drive member in a beam, especially within the wing or frame struts of a window or a door, in such a manner that the groove within the beam and the groove base attached depression does not have to be cut in the same working direction as the groove.

A further object of the present invention is the provision of a window fastener exhibiting an unexpected technical effect whereby the drive housing within the beam (especially within the wing or frame strut of a window or a door of the sidewise kind within the acting area of the drive member) is anchored in spite of the fact that no formed depressions are present within the groove direction of this acting plane.

It is another object of the instant invention to eliminate the disadvantages of the previously-described known practice; consequently, a main task of this invention is to be provide a procedure for mounting the gear locks of edge closures or similar connecting-rod fixtures within a strut mounted in a gear-rack groove of the frame of windows by which, within the strut, the depression which extends from the groove for incorporating the gear housing, as well as the three holes for the penetration of the operating handle pin and the rosette-fastening bolts into the gear housing, can be fabricated at the same time.

SUMMARY OF THE INVENTION

In general, the invention consists of a window fastener having a drive with at least one in one rotatable member positioned in a housing, the member being engaged with a push member guided within the housing. The push member may be, for example, a gear rack. The housing, by straight edges and areas, is limited by a groove and with an area limited by bow-shaped edges and areas by itself continuous through the groove base to bow-shaped depression within a beam etc., and is received especially within the wing or frame strut of a window or door. It is fastened by bolts which are parallel to the direction of the axis of the rotatable member and extend into bores in the housing. The pinion is contained in a partially-cylindrical limited housing area on the back side of the straight edge and areas containing a limited housing area and the holes 16 containing extensions are suitably arranged. For receiving the pinion-containing housing areas, as well as the holes containing the extensions, several holes extending axially and at right angles to the length of the groove are provided. The holes with their axes are positioned behind the groove base, but penetrate the groove base.

More specifically, as far as the fastening bolts for the drive and for fastening the handle rosette on the frame of a window are concerned, the handle rosette is equipped with two fastening holes arranged a standard distance from each other.

The procedure for mounting drive locks of edge closures or similar gear rack fixtures integral with a gear-rack groove arranged in the frame of a window assures that the drive housing with the pinion containing area as well as the areas positioned at the side from it containing the engagement for the fastening bolts, is inserted into one depression which is connected to the groove base of the gear-rack groove. The profile area located directly behind the gear rack is interrupted by transverse holes 21, 22$^1$, 22$^2$ which have parallel axes and penetrate the groove base. Its surface area on its total width from the front side of the frame can be brought in and the part area which broke through the groove base of the holes is used as receiver for each of the part sections of the drive housing.

The special advantage of this operative procedure is that it may be done with the use of a common drill and that the drilled material is kept within small limits. In practice only a little weakening of the frame cross-section in the area of the drive seats provides the operative characteristics set forth.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 2:
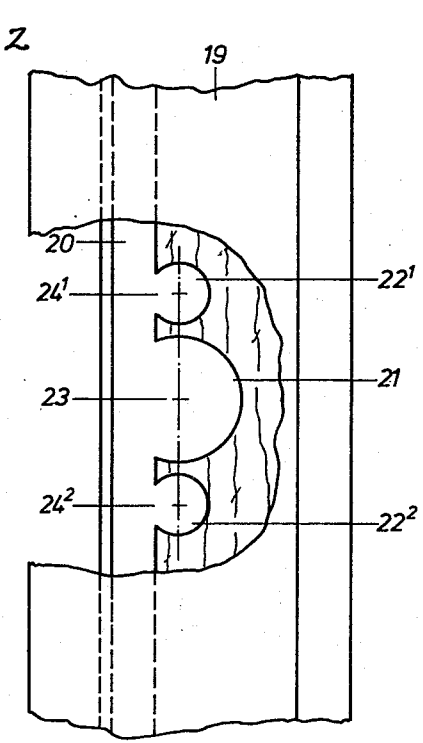
FIG. 2 is a front elevational view of a window frame with a portion broken away and adapted to receive the fastener.

In the beam of a window fastener 1 a drive housing 2 is fastened to its back side a rotatable member in the form of a gear pinion 3 is positioned. A push member 4 designed as a gear rack is guided in the housing. The pinion 3 is engaged with the holes 5 of this gear rack.

The drive housing 2 consists of two identical housing halves 6 which come together on the beam with the longitudinal middle line parallel to the plane of rotation of the pinion 3. These housing halves 6 have an approximate U-shape in plan view and the housing has on its base part 7 two cross-walls 8 and 9 positioned transversely and in spaced, parallel relationship. The end edges are pressed together in the previously-mentioned longitudinal plane.

The transverse wall 9 of the drive halves 6 which is furthest away from the axis of the pinion 3 is equipped with two riveted bars 11 (FIGS. 3 and 4) which penetrate slots 12 within the beam, these bars being headed over on their outer sides. The cross walls 9 of the two housing halves 6 are positioned over their total length on the back side of the beam.

Between the cross walls 8 and 9 of the two housing halves 6 is located the drive rack 4, displacably guided on the back side of the beam and guided adjacent the pinion 3 in engagement with the holes 5 in such a way that, during turning of the pinion 3, the radial reaction forces acting on the gear rack 4 are absorbed by the cross walls 9.

On the transverse walls 8 forming the rear wall of the base 7 of each housing half 6 are arranged extensions 14 directed backwards and located a certain sideways distance from the outline of the cylindrical area 15 of the housing halves 6 containing the pinion 3. Preferably, only one of these extensions 14 is formed on each of the two housing halves 6 and the two housing halves 6 are of the same shape. The two housing halves 6 provided the drive housing 2 with two extensions 14 on different sides of the partially-cylindrical housing areas 15. The extensions 14 have preferably a rectangular cross-section and are always equipped with a hole 16 extending parallel to the turning axis 10 of the pinion 3, the hole preferably being tapped. The axis of the two holes 16 are positioned in parallel with the axis of the pinion 3 and in a common plane parallel to the longitudinal direction of the plane of the gear rack 4.

The free end areas of the extensions 14 are concentric with the hole 16 and shaped as a partially-cylindrical area 17. They have in their middle area at least one lug 18 with a cutting edge.

It should be pointed out that the extensions 14 along with the back walls 8 of the foot parts 7 of the driving housing 2 can be connected in such a way that only after the mounting of the driving housing 2 are the extensions 14 brought to full thickness. In this case it would be necessary to cut the threads into the holes 16 after the mounting of the drive housing 2, so that an uninterrupted thread design is assured.

Figure 1:
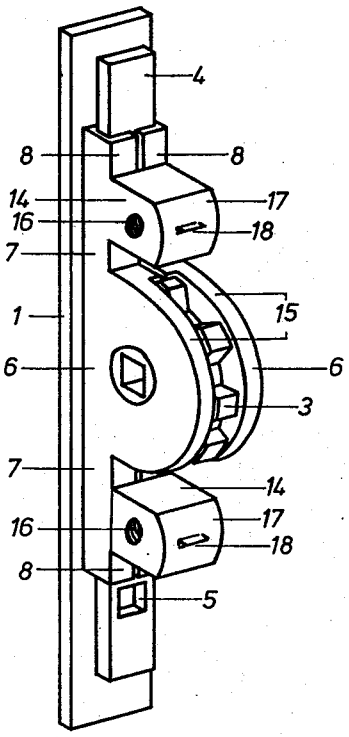
FIG. 1 is a perspective view of a window fastener constructed in accordance with the principles of the present invention.

In FIG. 1 can especially be seen that the drive housing 2 is of the same thickness throughout its entire area and that the extensions 14 have the same thickness.

For the mounting of the gear-rack drive 1, longitudinal groove 20, is required, located within the frame 19 of the window. The groove is milled into the notch area of the frame 19 and receives the cuff beam 1 as well as the drive bar 4 guided on the back side of the beam. Also, the base part 7 of the driving housing 2 with its straight areas and edges is received by the groove 20. The back walls 8 support themselves on the groove floor or base (FIG. 3) and the side walls are positioned along the side wall surfaces of the groove (FIG. 4).

Figure 3:
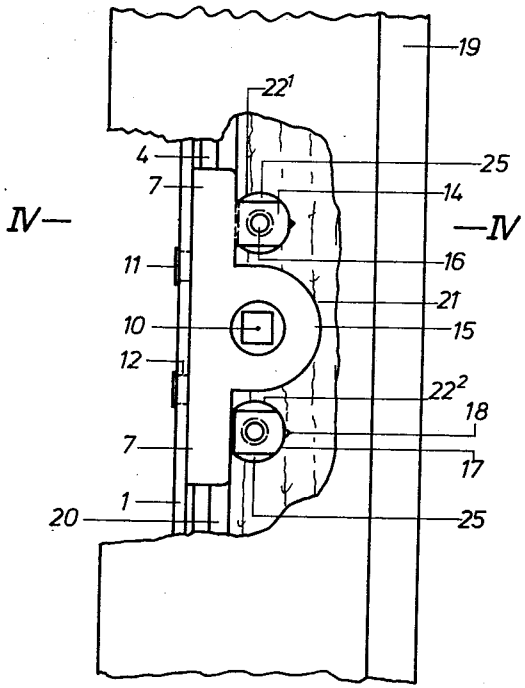
FIG. 3 is a front elevational view of the window frame with the fastener in place.

For receiving the partially-cylindrical housing portion 15 fitted to the diameter of the pinion 3, a hole 21 of corresponding diameter is made, positioned transversely of the longitudinal direction of the groove 20. It is parallel to the frame 19 and at both sides of this hole 21 are made two smaller holes $22^1$ and $22^2$ which are equidistant from and parallel to the axis of hole 21. All three holes 21, $22^1$ and $22^2$ are, therefore, positioned on a common plane parallel to the groove floor, but spaced behind the groove. The distance this plane is spaced from the groove base is selected in such a way that each of the holes 21, $22^1$ and $22^2$ penetrates with its peripheral line the groove floor and, therefore, creates in them openings 23, $24^1$ and $24^2$. These openings 23, $24^1$ and $24^2$ within the groove floor are large enough that the partially-cylindrical housing portion 15, enclosing the pinion 3, can be introduced laterally into the hole 21, while the extensions 14 can be moved laterally into the holes $22^1$ and $22^2$, as indicated in FIG. 3.

The housing portion 15 containing the pinion 3 is positioned with its semi-cylindrical periphery against the wall of hole 21. In the same way the partially-cylindrical cylindrical rear surfaces 17 of the two extensions 14 meet the surfaces of the two holes $22^1$ and $22^2$. The cutting-type lugs 18 penetrate laterally the walls of the two holes $22^1$ and $22^2$ and, therefore, operate as a practical position fixation. All the holes 21, $22^1$ and $22^2$ are formed as blind holes which end approximately at the level of the lower side wall of the groove 20 within the frame 19.

Figure 4:
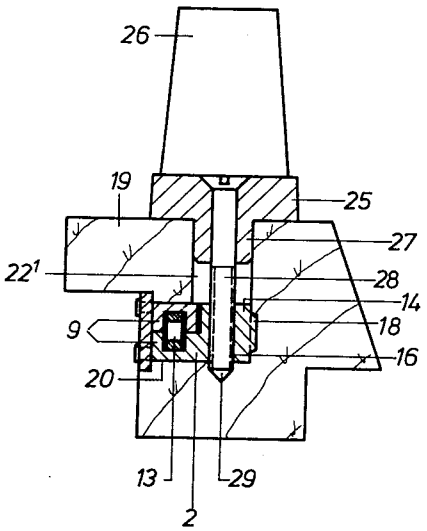
FIG. 4 is a horizontal sectional view taken on the line IV—IV of FIG. 3.

The open ends of the holes are shown in FIG. 4, covered by the support rosette 25 of a handle 26. From beneath the rosette 25 extends the square pin (not shown) of the handle 26 and it engages the square nut of pinion 3 through the hole 21 inside the frame 19. Each of the two holes $22^1$ and $22^2$ of the frame 19 carries a sleeve 27 located on the underside of rosette 25. Each of the two sleeves 27 is penetrated by a bolt 28 which in turn penetrates the threaded bore 16 of a corresponding extension 14 on the drive housing 2. With the help of the two fastening bolts 28, not only is the support rosette 25 of handle 26 located in fixed position, but also the drive housing 2 on the frame 19. When the bolts 28 are equipped at their ends with points 29 and have a corresponding length, then each point can extend downwards out of the threaded bore 16 of extension 14 and penetrate the material of the frame 19. The fastening action of the screws 28 for the drive housing 2 is thereby increased in a favorable manner.

It should also be pointed out that the housing halves 6 for forming the driving housing 2 may be fabricated especially advantageously as a pressure molding. In this case, it is possible that the complete drive housing 2 can be made as one piece, when the pinion 3 is made without any support band and is only equipped with a centrally-located bore. Then, during mounting of the drive and to form a support band, a sleeve is pressed into the hole of pinion 3 and this hole is of square shape as seen from the side. On the other hand, it is also possible to shape the two housing halves 6 or the drive housing 2 from stamped metal parts.

FIG. 3 of the drawing especially shows that, after the mounting of the drive housing 2 in the groove 20 and the holes 21, $22^1$ and $22^2$ of the frame 19, segmentally-shaped hollow spaces 25 are formed between the longitudinal side surfaces of the extensions 14 and the neighboring walls of the holes $22^1$ and $22^2$. The possibility is presented to drive through the open end of the holes $22^1$ and $22^2$ into the hollow space 25 correspondingly-shaped fill pieces for filling these hollow spaces. In such case, when flat grooves are worked into the longitudinal side areas of the extensions 14 parallel to the direction of the axis of the holes 16 and when the fill pieces carry correspondingly flat bars, then it is possible to bring about a form-locking positioning of the extensions 14 and for the drive housing 2 in the holes $22^1$ and $22^2$.

Finally, it should be mentioned that the drive housing 2, as described previously, may be positioned without any difficulty in the frame 19 so that the depression opening on the groove floor was formed from the side of the groove.

Figure 5:
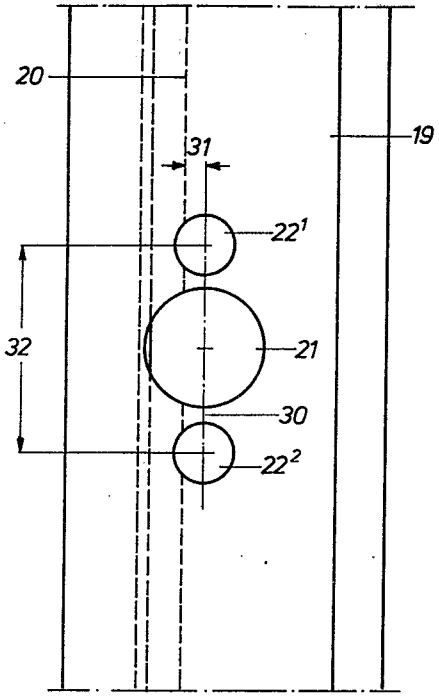
FIG. 5 is a front elevation of a window frame showing drilled holes in place.

In order that a window fastener with a drive housing 2 of FIG. 1 equipped with a wing closure device for windows can be installed with the least effort into a frame 19 which has a machined or otherwise formed gear rack 20, only three holes 21, $22^1$ and $22^2$ are cut into the frame 19 from its front side. The axes of all three holes 21, $22^1$ and $22^2$ are positioned on a common plane 30 (FIG. 5) and are placed parallel to the longitudinal direction of the gear-rack groove 20 and at a distance 31 behind the floor of the gear-rack groove 20. The axis of all holes 21, $22^1$ and $22^2$ run parallel to the groove floor, but transversely of the length of the groove.

Figure 6:
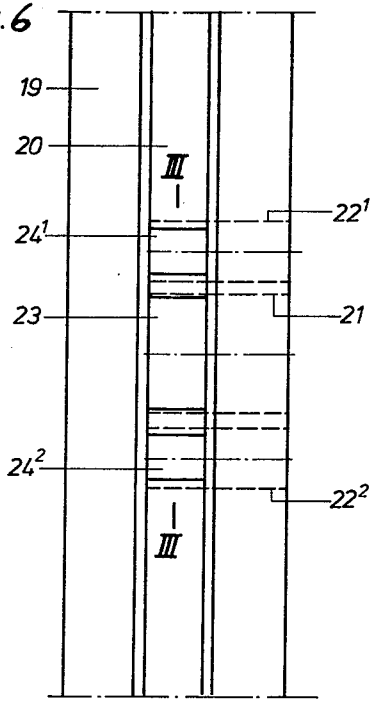
FIG. 6 is a side elevational view of the frame.

The distance 31 of the axis plane 30 from the base of the groove 20 is selected in such a way that the groove floor in the area of each of the holes 21, $22^1$ and $22^2$ intersects the surface line of these holes, so that within the groove floor are created openings 23, $24^1$ and $24^2$ as it can be seen from FIG. 6. The diameters of the holes 21, $22^1$ and $22^2$ are always selected only for such a size as it is absolutely required. For instance, the hole 21 is provided with a diameter of 25 mm, and the holes $22^1$ and $22^2$ each with a diameter of only 12 mm. The distance 31 of axis plane 30 that these holes are located from the groove floor is approximately 4 mm. This assures that the openings 23, $24^1$ and $24^2$ which are created in the area of the connecting rod 20, are so dimensioned, that through them can be pushed the partial portions 15 and 14 of the driving housing 2 from the side of the gear-rack groove 20 and then pushed into the area of the holes 21, $22^1$ and $22^2$.

The axial distance 32 of the two holes $22^1$ and $22^2$ from each other corresponds to a standard dimension of 43 mm, whereby the axis of the hole 21 is exactly half way between them.

With these dimensional ratios, webs are always left between the neighboring holes 21 and 22[1] or 21 and 22[2] in the material of the frame 19, as can especially clearly be seen from FIG. 2. These webs, however, do not hinder the insertion of the drive housing, because a cut is always present between the backside extensions 14 and the driving housing 2 and its part cylindrical housing area 15 which incorporates these webs during mounting of the driving housing 2 into the frame 19.

It should also be mentioned that with the procedure of this invention, all three holes 21, 22[1] and 22[2] can be formed at the same time in the frame 19 by use of a commonly-known three-cluster drill head having drill distances which correspond to the holes. Into this three-fold drill head, three so-called "Forstner" drills may be inserted, the middle one having a working diameter of 25 mm and the two outer ones having a working diameter of 12 mm. With the help of these drills all three holes 21, 22[1] and 22[2] can be fabricated as blind holes of the same depth, which as clearly shown in FIG. 6, end at the same level with the lower side area of the gear-rack groove 20.

After the described procedure has been carried out in one step, the necessary depressions have been formed for the mounting of the drive housing 2 within the frame 19 in connection to the groove 20. The openings directed towards the front of the wing strut 19 are also made through which the pin of the service handle into the nut of the pinion 3 may enter. The fastening bolts for the support rosette of the service handle may be screwed into and anchored in the threaded holes 16 of drive housing 2.

A beneficial effect is accomplished through the previously-described working procedure during mounting of the driving means of edge closures and similar connecting-rod fixtures. This is because a machining procedure entering from the open side of the gear-rack groove 2 can be completely eliminated on the frame 19, in spite of the fact that a drive housing is used in which the fastening bolts for the service handle rosette enter the threaded parts of the housing.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. A locking arrangement for use on the frames of doors and windows, the frame having a planar side face and a planar edge face substantially perpendicular to said side face, comprising a. a recess formed in the frame, said recess being formed of a combination of i. a groove of uniform depth formed in the edge face, and having a floor spaced from and parallel to the edge face, ii. a main hole having a first cylindrical peripheral surface formed in the frame through the side face and spaced from the edge face, the axis of the main hole being parallel to the edge face with the first surface intersecting the groove floor, iii. two side holes each having a second cylindrical peripheral surface formed in the frame and opening onto the side face, each side hole being spaced from the edge, the axis of the side hole being outside of the main hole and parallel to the edge face with the second surface intersecting the groove floor, each side hole being substantially separated from the main hole so that a bridge of frame material lies between them, b. a locking device which allows a rotation of a handle to cause locking action, comprising i. a drive housing including an elongated base part having a side and mounted in the groove, a pinion housing extending from the side and into the main hole, and an extension extending from the side spaced from the drive housing and extending into the side hole, ii. a pinion mounted in the pinion housing for engagement by the handle, and iii. a push member mounted in the base part for engagement with the pinion for effecting the locking action.

2. A locking arrangement for use on the frames of doors and windows, the frame having a planar side face and a planar edge face substantially perpendicular to said side face, comprising a. a recess formed in the frame, said recess being formed of a combination of i. a groove of uniform depth formed in the edge face, and having a floor spaced from and parallel to the edge face, ii. a main hole having a first cylindrical peripheral surface formed in the frame through the side face and spaced from the edge face, the axis of the main hole being parallel to the edge face with the first surface intersecting the groove floor, iii. a side hole having a second cylindrical peripheral surface formed in the frame through the side face and spaced from both the edge and the first surface, the axis of the side hole being outside of the main hole and parallel to the edge face with the second surface intersecting the groove floor, and b. a locking device which allows a rotation of a handle to cause locking action, comprising i. a drive housing including an elongated base part having a side and mounted in the groove, a pinion housing extending from the side and into the main hole, and an extension extending from the side spaced from the drive housing and extending into the side hole, ii. a pinion mounted in the pinion housing for engagement by the handle, and iii. a push member mounted in the base part for engagement with the pinion for effecting the locking action.

3. A locking arrangement as recited in claim 2, wherein a second extension is provided extending from the said side, on the opposite side of the pinion housing from the first extension and both extensions are equally spaced from the pinion housing.

4. A locking arrangement as recited in claim 2, wherein the width of the extension measured parallel to the length of the drive housing is smaller than the diameter of the side hole and is approximately equal to the width, measured parallel to the length of the groove, of an aperture formed by the intersection of the groove and the side hole and through which the extension passes.

5. A locking arrangement as recited in claim 2, wherein the thickness of the extension equals the thickness of the base part.

6. A locking arrangement as recited in claim 2, wherein the free end of the extension is semi-cylindrical and of radius equal to that of the side hole.

7. A locking arrangement as recited in claim 2, wherein a cutting lug is attached to the free end of the extension and is adapted to penetrate the second cylindrical peripheral surface.

8. A locking arrangement as recited in claim 2, wherein the drive housing is formed of two halves joined at a plane perpendicular to the axis of the pinion.

9. A locking arrangement as recited in claim 8, wherein the halves are mirror-images of one another.

10. A locking arrangement as recited in claim 8, wherein said extension is attached to only one half.

11. A locking arrangement as recited in claim 2, wherein the extension has in it a threaded bore.

12. A locking arrangement as recited in claim 2, wherein the side hole has a blind end and an axial, conical depression at its blind end, a sleeve is provided at the open end of the side hole, the sleeve having an axial bore, a bore is provided in the extension, and a bolt is provided which passes through the sleeve bore, the extension bore and the depression.

13. A locking arrangement as recited in claim 12, wherein a handle rosette is provided and the sleeve is located on one surface of the rosette.

* * * * *